United States Patent [19]

Richey et al.

[11] 4,258,804

[45] Mar. 31, 1981

[54] RELEASABLE DRILL STRING STABILIZER

[76] Inventors: Vernon T. Richey; Edward L. Moses, Jr., both of 1775 St. James Pl. Suite 170, Houston, Tex. 77056

[21] Appl. No.: 35,947

[22] Filed: May 4, 1979

[51] Int. Cl.[3] ..... E21B 17/10; F16C 1/26

[52] U.S. Cl. ..... 175/325; 166/241; 166/301; 308/4 A

[58] Field of Search ..... 166/241, 301, 315, 217, 166/243; 175/325, 323, 320; 308/4 A

[56] References Cited

U.S. PATENT DOCUMENTS

| | | | |
|---|---|---|---|
| 2,163,932 | 6/1939 | Bettis | 166/241 |
| 2,998,848 | 9/1961 | Wright et al. | 166/243 |
| 3,065,005 | 11/1962 | Hall, Sr. et al. | 166/241 X |
| 3,482,889 | 12/1969 | Cochran | 166/241 X |
| 3,916,998 | 11/1975 | Bass, Jr. et al. | 166/315 X |
| 4,101,179 | 7/1978 | Barron | 175/325 X |
| 4,105,262 | 8/1978 | Richey | 166/241 X |
| 4,146,060 | 3/1979 | Garrett | 175/325 X |

*Primary Examiner*—Stephen J. Novosad
*Attorney, Agent, or Firm*—Guy E. Matthews

[57] ABSTRACT

A releasable drill string stabilizer is provided which includes a stabilizer body, a pair of end caps mounted with said body and a pair of clamping wedges positioned relative to the end caps and stabilizer body to clamp the stabilizer to a suitable drill string in various desired locations. A pin means and retainer slot means is provided for connecting the body and wedges relative to each other to prevent movement of such elements relative to each other and the drill string.

8 Claims, 3 Drawing Figures

RELEASABLE DRILL STRING STABILIZER

BACKGROUND AND SUMMARY OF THE INVENTION

This invention relates to the field of stabilizers used in the oil well drilling operations to aid in drilling directional holes, straight holes and to prevent "sticking" between the drill string and the bore hole by having the blades of the stabilizer prevent the drilling string from contacting the sides of the well bore hole. In the past, stabilizers were made up within the drill string as the string was run into the hole; however, this arrangement has several undesirable features because it adds tool joint connections to the drill string, which increases possible points of failure in the drill string and causes variation in drill collar stand lengths which increases trip time and creates unsafe operational conditions for rig personnel and further requires a special bottom hole assembly which increases drilling costs and does not permit adjustment of the stabilizer along the drill string without changing subs which further increase drilling costs.

The use of lock-on stabilizers has been suggested to solve these undesirable aspects. Typically, the lock-on stabilizer has a body with externally extending blades, two end caps for connecting to the body, an inside solid locking ring and two outside solid locking rings with a single tapered surface for each ring. The stabilizer is connected between pin and box joints on the drill string by positioning the inside locking ring inside the body, thereafter positioning an outside locking ring on either end of and with the tapered surface facing the inside locking ring. Two end caps are used to force the rings together within the body to connect the stabilizer to the drill string. A major difficulty with this arrangement has been its inability to be reused after once being attached. This difficulty is caused by the inherent inability of the solid rings to clamp around the drill string without being deformed.

As further set forth in U.S. Pat. No. 3,916,998, U.S. Pat. No. 4,101,179 and U.S. Pat. No. 4,105,262, combinations of split rings and/or wedging clamps are used for attaching the stabilizers to the drill string.

It is one object of the present invention to provide a stabilizer of simple and inexpensive construction which is releasably connected to a drill string.

BRIEF DESCRIPTION OF THE DRAWINGS

Other objects and advantages of the invention will become apparent upon reading the following detailed description of the invention upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
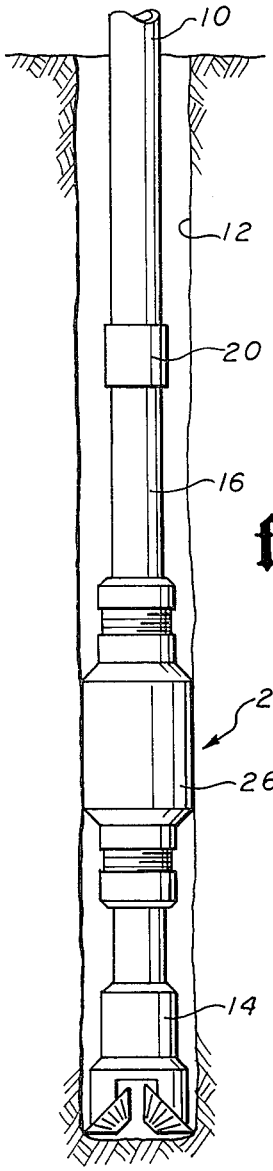
FIG. 1 is an elevational view partly in section showing a stabilizer of the present invention installed on a drill string in a well.

As illustrated in FIG. 1, a drilling string 10 is positioned within bore hole 12 which bore hole 12 is formed by drilling bit 14 in a manner well known in the art. As is also well known, when the drilling bit 14 drills a bore hole 12 deeper within the earth formation, it is necessary to add a drill collar 16, which is secured to the drilling string 10 by conventional pin and box joints as at 20. As illustrated, the stabilizer of the present invention is generally designated by the numeral 22 and is secured to drill collar 16; however, it is to be understood that many stabilizers or multiple stabilizers may be attached to the drill string at any desired elevation.

Figure 2:
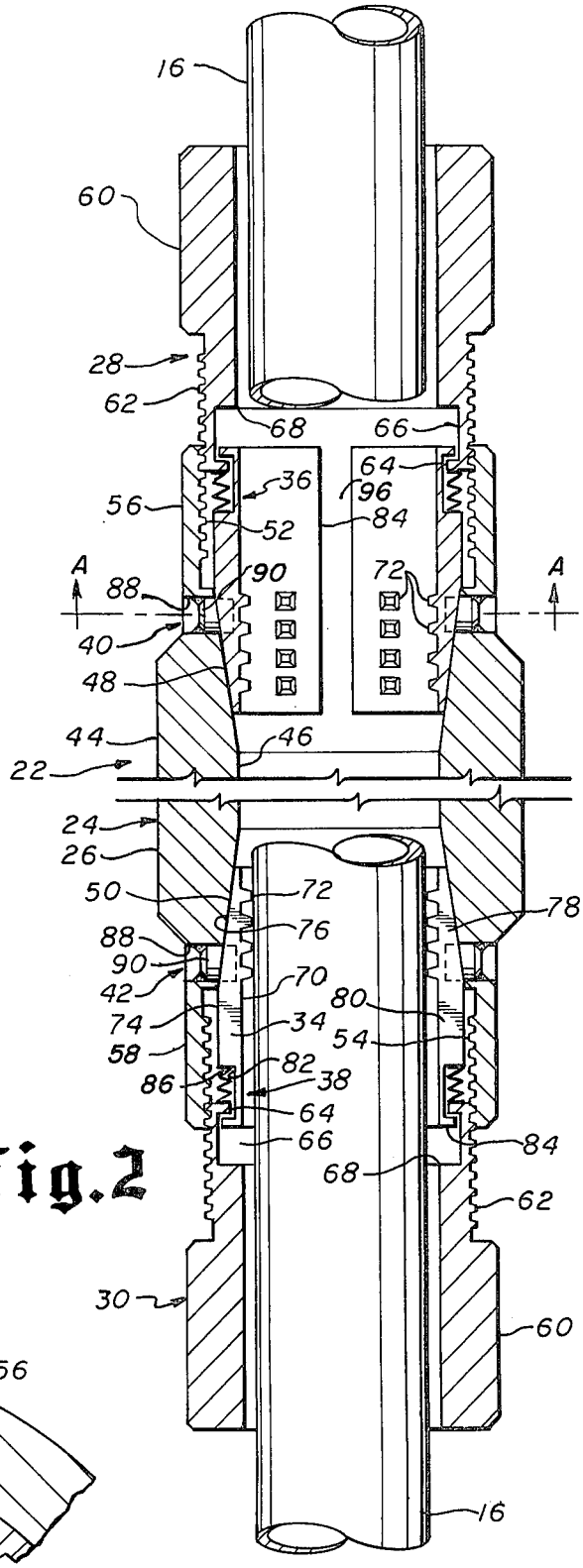
FIG. 2 is an enlarged elevational view partly in section illustrating a detailed construction of the invention shown in FIG. 1.

As illustrated in FIG. 2, stabilizer 22 includes a stabilizer body 24 having stabilizer blades 26 extending outwardly therefrom to contact the sides of the well bore 12 (FIG. 1). Stabilizer 22 also includes end caps 28 and 30, clamping wedges 32 and 34, a plurality of spring means 36 and 38 and pin means 40 and 42.

Stabilizer body 24 includes a central section 44 having an interior surface 46 which contacts drill collar 16. On either side of the central interior surface 46 are two oppositely tapered surfaces 48 and 50 extending away from the central section interior surface 46. Each of the tapered surfaces 48 and 50 extends outwardly to the interior thread sections 52 and 54, respectively.

As best illustrated in FIG. 2, stabilizer blades 26 extend outwardly to contact the well bore 12 as is well known in the art and extend substantially the longitudinal length of the stabilizer body 24 and are integrally connected at each end with the exterior ends 56 and 58, respectively, of respective interior threaded sections 52 and 54.

Each of the end caps 28 and 30 includes a collar 60 for mounting around the drill string 16 and a plurality of exterior threads 62 for threadedly engaging with threads 52 and 54, respectively, of the stabilizer body 24. A cap retainer lip or member 64 is mounted on the end of the thread sections 62 and forms a slotted section 66 defined by the lip or extension 64 and corner or edge 68 of the end cap 60.

Clamping wedge members 32 and 34 include interior surface 70, including a plurality or multiplicity of serrations or teeth 72 for tightly gripping the drill string 16. The exterior surface 74 of the wedge members 32 and 34 includes a tapered surface area 76 which complimentary matches the tapered surface 48 and 50, respectively, of stabilizer body 24 adjacent the teeth 72 to form a wedge shaped section 78. The exterior surface 74 also includes section or portion 80 which includes a spring retaining and receiving slot 82 formed by the lip 84 and edge 86. As illustrated in FIG. 2, the lip 84 overlaps with the lip 64 of end cap 16 to retain wedge members 32 and 34 in position, as will be set forth hereinbelow.

A plurality of wave spring means or other suitable type spring means 36 and 38, respectively, is positioned in the retaining slot 82 to continually force the wedge members 32 and 34 toward the center section 46 of stabilizer body 24 which thus causes the wedge shape members 32 and 34 to tightly grip the drill collar 16.

As fully illustrated in FIG. 2, each of the wedge shape members 32 and 34 extends partially around the drill collar 16 such that each longitudinal end 84 (only one of which is shown) defines a longitudinal gap 96, and are forced toward each other to narrow such gap 86 as the members 32 and 34 tightly grip the string 16.

Figure 3:
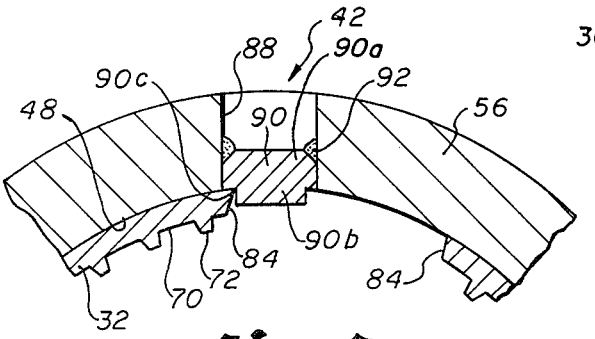
FIG. 3 is a partial cross-section taken along A—A of FIG. 2.

As fully illustrated in FIGS. 2 and 3, pin means 42 and 40 are inserted through openings 88 adjacent each end (not numbered) of the blades 26 which opening 88 extends through the stabilizer body 24. Pins 90 are inserted into the openings and welded as at 92 to the stabilizer body 24 to prevent rotational movement of the wedge members 32 and 34 and the stabilizer body.

As further illustrated, such pin means 42 defined by pin 90 extends into opening 88 so that the head 90*a* is inserted therein and the retainer section 90*b*, which is of a smaller diameter than head 90*a*, extends through opening 88 and into the gap 96 formed by the longitudinal ends 84 or the member 32 and 34. It should be understood that the retainer section 90*b* does not extend past the interior surface 70 of wedge members 30 and 32, which thus prevents wear and tear of pin members 40 and 42 adjacent the drill collar 16.

As end caps 28 and 30 are tightened to the threaded interior section of body 24, spring means 36 and 38 are compressed, which causes the spring means 36, 38 to exert force on the edge 86 to force wedge members 32 and 34 toward central section 44 of body 24. Tightening of end caps 28 and 30 or rotation of the drill string 16 causes the end caps 28 and 38 and body 24 to rotate such that the longitudinal end 84 of members 32 and 34 engage the corner 90*c* formed by the intersection of head 90*a* and end 90*b* to prevent movement of the wedge members 30 and 32 relative to body 24 and end caps 28 and 30.

In this manner, once the stabilizer 22 is assembled as hereinabove described, and the teeth 72 tightly grip the drill string 16 due to the urging of the spring means 36 and 38 urging the clamping means 32 and 34, respectively, toward the central section 44 of stabilizer body 24 to enable the teeth 72 to tightly grip the drill string, then movement of the stabilizer body 24 relative to different parts of the stabilizer body and the drill string 16 is prevented.

Thus, it is apparent that there has been provided in accordance with the present invention a stabilizer which has been described in terms of a specific embodiment thereof; however, it should be evident that many alternatives, modifications and variations will be apparent to those skilled in the art from the foregoing description. Accordingly, it is intended to embrace all such alternatives, modifications and variations that fall within the spirit and scope of the appended claims.

What is claimed is:

1. A releasable stabilizer for positioning on a drill string, comprising:

(a) a stabilizer body positioned around the drill string having:

(1) threads on the interior surface of each end of said body;

(2) tapered surfaces on the interior of said body extending from each of said threads to a middle portion of said body;

(3) stabilizer blades extending from the exterior of said body to prevent sticking of the drill string;

(b) an end cap mounted with each end of said body having:

(1) exterior threads on one end for threadedly engaging one of each of said set of threads on the end of each body;

(2) an end cap retainer slot formed on the interior of said end cap, said slot being positioned on the interior threaded end;

(c) at least one clamping wedge for each end of said body, including:

(1) a smooth interior surface having teeth for gripping the interior of the drill string;

(2) an exterior surface having a tapered surface complimentary matching and adjacent said tapered surfaces of said body;

(3) said exterior surface further including a spring retaining and receiving slot and a retaining lip section, said lip section extending into and being received by said end cap retainer slot for retaining said wedge in position relative to said body and drill string;

(d) spring means mounted in said spring retaining and receiving slot for tightly retaining each of said clamps relative to said body and for forcing each of said clamps inwardly toward each other to enable said tapered surface of each of said wedges to slide on the respective tapered surfaces of said body to cause said wedges to tightly engage said drilling string; and (e) pin means extending through said body and contacting said clamping wedge to prevent rotational movement of said wedge relative to said body.

2. The structure as set forth in claim 1, wherein:

said pin means includes a retainer end extending outwardly through said body wherein one longitudinal end of each of said clamping wedge contacts said retainer end to prevent rotational movement of said wedge relative to said body.

3. A stabilizer for positioning on a drill string including:

(a) a stabilizer body having an interior surface and an exterior surface including outwardly extending stabilizer blades;

(b) engaging means mounted on the interior surface of the stabilizer body for tightly engaging the drill string;

(c) urging means mounted with said body for continuously urging said engaging means to tightly engage the drill string;

(d) rotation stop means extending through said body to engaging means to prevent rotational movement of said engaging means relative to said body.

4. A releasable downhole well tool for positioning on the exterior of a pipe string and adapted to provide a well service function, said tool comprising:

(a) a tool body positined around the pipe string having:

(1) threads on the interior surface of each end of said body;

(2) tapered surfaces on the interior of said body extending from each of said threads to a middle portion of said body;

(b) an end cap mounted with each end of said body having:

(1) exterior threads on one end for threadedly engaging one of each of said set of threads on the end of each body;

(2) an end cap retainer slot formed on the interior of said end cap, said slot being positioned on the interior threaded end;

(c) at least one clamping wedge for each of said body, including:

(1) a smooth interior surface having teeth for gripping the interior of the drill string;

(2) an exterior surface having a tapered surface complimentary matching and adjacent said tapered surfaces of said body;

(3) said exterior surface further including a spring retaining and receiving slot and a retaining lip section, said lip section extending into and being received by said end cap retainer slot for retaining said wedge in position relative to said body and drill string;

(d) spring means mounted in said spring retaining and receiving slot for tightly retaining each of said wedges relative to said body and for forcing each of said wedges inwardly toward each other to enable said tapered surface of each of said wedges to slide on the respective tapered surfaces of said body to cause said wedges to tightly engage said drilling string; and (e) pin means extending through said body and contacting said clamping wedge to prevent rotational movement of said wedge relative to said body.

5. The structure as set forth in claim 4, wherein:

said pin means includes a retainer end extending outwardly through said body wherein one longitudinal end of each of said wedges contacts said retainer end to prevent rotational movement of said wedges relative to said body.

6. A downhole well tool for positioning on the exterior of a pipe string including:

(a) a tool body having an interior surface and an exterior surface, said tool body being of a configuration to provide a well service function;

(b) engaging means mounted on the interior surface of the tool body for tightly engaging the drill string;

(c) urging means mounted with said body for continuously urging said engaging means to tightly engage the drill string;

(d) rotation stop means extending through said body to engaging means to prevent rotational movement of said engaging means relative to said body.

7. A downhole well tool for attachment to the exterior surface of a pipe string positioned within a well and adapted to provide a well service function, said downhole well tool comprising:

a tool body defining an internal opening through which said pipe string is adapted to extend;

tapered cam surface means being defined within said tool body;

clamping wedge means being positioned at least partially within said body and being movable radially inwardly by said tapered surfaces means upon linear movement of said clamping wedge means toward the center of said tool body;

gripping means being defined on said clamping wedge means and adapted to establish an immovable gripping relation with the outer surface of said pipe string upon radial inward movement of said clamping wedge means;

means for imparting controllable linear movement to said tapered clamping wedge means to establish said pipe gripping relation of said clamping wedge means; and means mounted with said tool body and engaging said clamping wedge means for preventing rotational movement of said clamping wedge means relative to said tool body.

8. The downhole well tool of claim 7, wherein the means for preventing rotational movement of the wedges comprises a pin having an end extending axially inwardly of the tool body internal opening.

* * * * *